US007036854B1

(12) United States Patent
Lai

(10) Patent No.: US 7,036,854 B1
(45) Date of Patent: May 2, 2006

(54) FLUSH BOLT

(76) Inventor: Ken Ming Lai, 1594-33rd Ave., San Francisco, CA (US) 94122

( * ) Notice: Subject to any disclaimer, the term of this patent is extended or adjusted under 35 U.S.C. 154(b) by 0 days.

(21) Appl. No.: 10/413,667

(22) Filed: Apr. 14, 2003

(51) Int. Cl.
*E05C 1/06* (2006.01)

(52) U.S. Cl. ..... 292/143; 292/141; 292/340; 292/341.12; 292/341.18; 292/DIG. 21; 292/DIG. 64

(58) Field of Classification Search ..... 292/336.3, 292/40, 141, 143, DIG. 21, DIG. 31, 340, 292/341.12, 341.18, 341.19, DIG. 64
See application file for complete search history.

(56) References Cited

U.S. PATENT DOCUMENTS

| | | | | | |
|---|---|---|---|---|---|
| 277,591 | A | * | 5/1883 | McKelvey | 292/40 |
| 642,749 | A | * | 2/1900 | Mcchesney | 49/183 |
| 1,162,945 | A | * | 12/1915 | Ohnstrand | 292/138 |
| 1,251,676 | A | * | 1/1918 | McCaffray | 411/368 |
| 1,338,713 | A | * | 5/1920 | Toney | 292/335 |
| 2,573,498 | A | * | 10/1951 | Scott | 411/71 |
| 2,721,750 | A | * | 10/1955 | Rudis et al. | 292/139 |
| 2,815,975 | A | * | 12/1957 | Check et al. | 292/143 |
| 2,819,107 | A | * | 1/1958 | Muessel | 292/143 |
| 2,874,986 | A | * | 2/1959 | Henrichs | 292/167 |
| 2,944,848 | A | * | 7/1960 | Mandolf | 292/181 |
| 3,007,732 | A | * | 11/1961 | Schlage | 292/341.12 |
| 3,095,225 | A | * | 6/1963 | Domsic et al. | 292/169.15 |
| 3,183,027 | A | * | 5/1965 | Powers | 292/40 |
| 3,556,573 | A | * | 1/1971 | Miller | 292/143 |
| 3,578,369 | A | * | 5/1971 | Coopersmith | 292/58 |
| 3,582,122 | A | * | 6/1971 | Foster et al. | 292/335 |
| 4,005,886 | A | * | 2/1977 | Lirette | 292/177 |
| 4,017,106 | A | * | 4/1977 | Salazar | 292/340 |
| 4,099,753 | A | * | 7/1978 | Gwozdz et al. | 292/177 |
| D261,478 | S | * | 10/1981 | Gauntt | D8/344 |
| 4,315,647 | A | * | 2/1982 | Wilzig et al. | 292/143 |
| 4,828,299 | A | * | 5/1989 | Poe | 292/139 |
| 4,854,618 | A | * | 8/1989 | Webster | 292/244 |
| 4,911,485 | A | * | 3/1990 | Wasilewski | 292/139 |
| 5,004,277 | A | * | 4/1991 | Campbell et al. | 292/166 |
| 5,016,930 | A | * | 5/1991 | Hamilton | 292/340 |
| 5,076,620 | A | * | 12/1991 | Campbell et al. | 292/138 |
| 5,328,217 | A | * | 7/1994 | Sanders | 292/341.19 |
| 6,666,486 | B1 | * | 12/2003 | Fleming | 292/145 |

FOREIGN PATENT DOCUMENTS

| | | | |
|---|---|---|---|
| GB | 460468 | * | 1/1937 |
| GB | 479231 | * | 2/1938 |

* cited by examiner

*Primary Examiner*—Brian E. Glessner
*Assistant Examiner*—Carlos Lugo
(74) *Attorney, Agent, or Firm*—Ken Ming Lai; Albert K. Lai

(57) ABSTRACT

A flush bolt mechanism to be mounted into a recess at the vertical edge of an inactive door of a pair of swinging doors. The flush bolt mechanism has a manually-activated trigger, a shaft connected to the trigger by a pin, a spring clip biasing the shaft, and a bolt to be projected into a strike plate which is mounted onto the door frame or the sill. The bolt mechanism is supported and elevated at the upper end by the front base which has a foot and by a cylindrical spacer placed at the round base. This flush bolt mechanism can simply be constructed with extruded aluminum or copper, and can be mounted into a recess at the vertical edge of an inactive door with ease, accuracy, and certainty.

2 Claims, 3 Drawing Sheets

FLUSH BOLT

REFERENCES CITED

Figure 1:
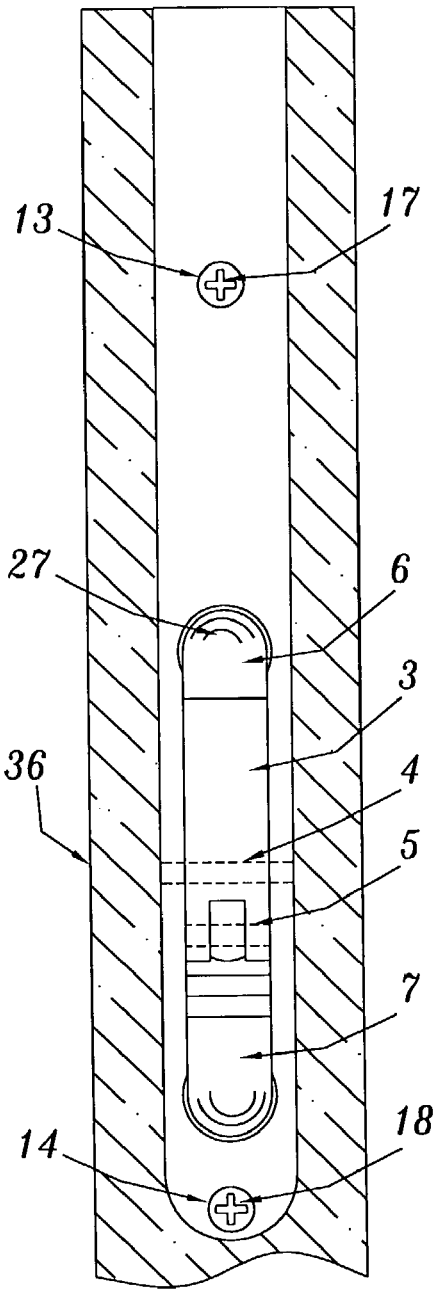

U.S. Pat. No. 1,162,945, December 1915, Ohnstrand . . . 292/143
U.S. Pat. No. 2,819,107, January 1958, Muessel et al. . . . 292/143
U.S. Pat. No. 3,578,369, May 1971, Coopersmith . . . 292/58
U.S. Pat. No. 4,005,886, February 1977, Lirette . . . 292/177
U.S. Pat. No. 4,099,753, July 1978, Gwozdz et al. . . . 292/177
U.S. Pat. No. 4,315,647, February 1982, Wilzig et al. . . . 292/143

BACKGROUND OF THE INVENTION

This invention relates to a manually activated flush bolt mechanism for latching the inactive door of a paired swinging doors. Flush bolts, automatically activated or manually activated, are commonly used to latch the inactive door. Two flush bolts are required to latch the inactive door: one at the top thereof, and one at the bottom. The retracted bolts of these mechanisms are usually flush with the respective horizontal top and horizontal bottom edges of the inactive door. Regardless whether the bolts are retracted or projected, these flush bolt mechanisms are also flush with the vertical edge of the inactive door, so that the active door can be closed. When the bolt mechanism is activated, the projected bolt at the horizontal top edge of the inactive door engages with a strike plate located at the door frame above the inactive door. Similarly, when a bolt mechanism is activated, the projected bolt at the horizontal bottom edge of the inactive door engages with a strike plate located at the floor or sill. When an inactive door has to be closed, the flush bolts' triggers have to be first activated, causing the bolts to project into their respective strike plates hence securing the inactive door in a locked position. When an inactive door has to be opened, the flush bolts' triggers have to be first reversibly activated, causing the bolts to retracted out of their respective strike plates thereby allowing the inactive door free to be opened.

The history of prior art reveals a number of flush bolt mechanisms which were designed to be mounted onto the vertical edge of an inactive door of a paired unit. The prior known flush bolt mechanisms can be classified into two broad categories: automatically-activated flush bolts (for instances, U.S. Pat. Nos. 3,578,369, 4,005,886 and 4,099,753), and manually-activated flush bolts (for examples, U.S. Pat. Nos. 1,162,945, 2,819,107, and 4,315,647). Both categories of flush bolts feature some generally recognizable parts: a unitary housing which holds all inner parts, a trigger member, a shaft, a spring (or another means) for biasing the shaft, and a slidable bolt to be projected into and engaged with a strike plate. In the first category as illustrated by the U.S. Pat. No. 4,099,753, the closing active door activates the trigger which then moves the shaft vertically to project a bolt into a strike plate latching the inactive door. In the second category as shown by the example of U.S. Pat. No. 4,315,647, the trigger has to be manually pulled to move the shaft which is connected at one end to the bolt, projecting the bolt into a strike plate. The bolt mechanisms referenced hereby have exhibited in various designs and shapes with one or multiple desirable characteristics. It is desired that the bolt mechanisms can endure heavy usage. It is also desired that the bolt mechanisms can be reliably projected thereby securing the inactive door in a locking position in case of any potential break-in by burglars. Furthermore, it is also desired that the bolts mechanism can be reliably retracted thereby freeing the inactive door to be opened in case of any fire or emergency exit. Finally, the bolt mechanisms have to withstand any extreme heat or cold. Therefore, the bolt mechanisms have to be made sturdy with sufficient activation of the mechanisms and sufficient projection and retraction of the bolts.

Flush bolt mechanisms of prior art are too bulky or too difficult to be mounted onto the vertical edge of an inactive door of a paired unit. They often require multiple routings or cuttings on the vertical edge of the inactive door to achieve the desirable width, length, and depth to accommodate the bolt mechanisms. This invention is better than the prior known bolt mechanisms because it has a simpler design, fewer parts, and a more uniform height. This invention features a heavy-duty flush bolt mechanism which has a strong housing, a solid bolt, a sturdy shaft, and an easily accessible trigger. It offers a reliable projection of the bolt which is the vertical edge of the inactive door 36. The diameter of the screw-holes 13, 14 in the housing is slightly bigger than the Phillips screw heads' diameter, allowing the screws to fit into screw-holes, hence the bolt mechanism is flush with the vertical edge of the inactive door.

Figure 2:
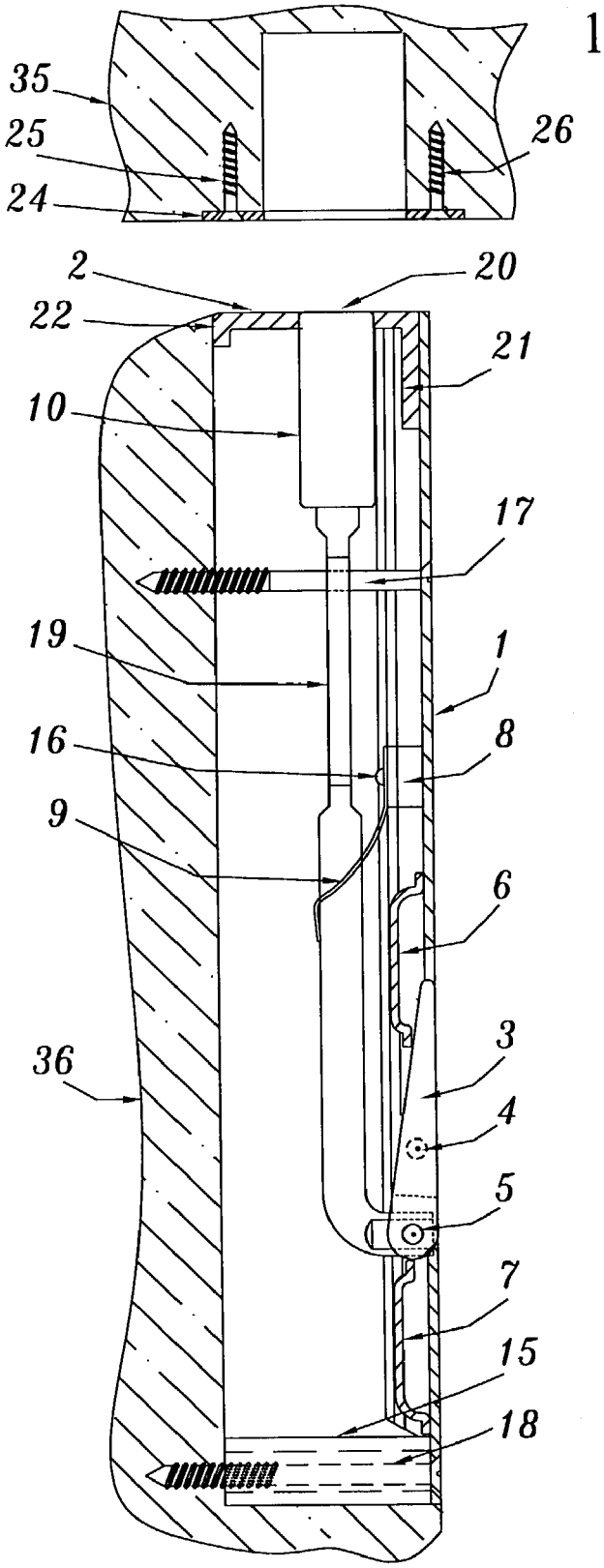
Figure 3:
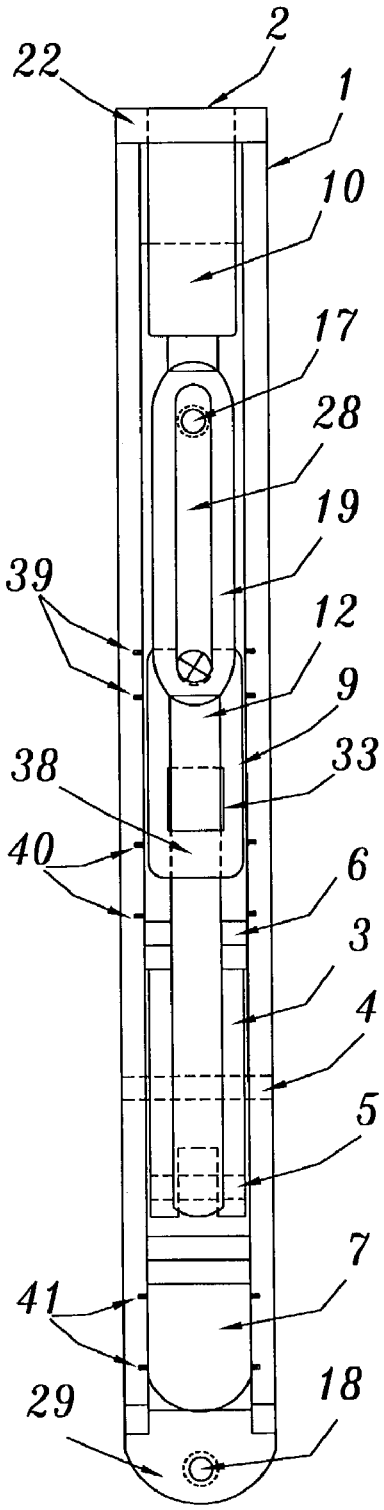
Figure 4:
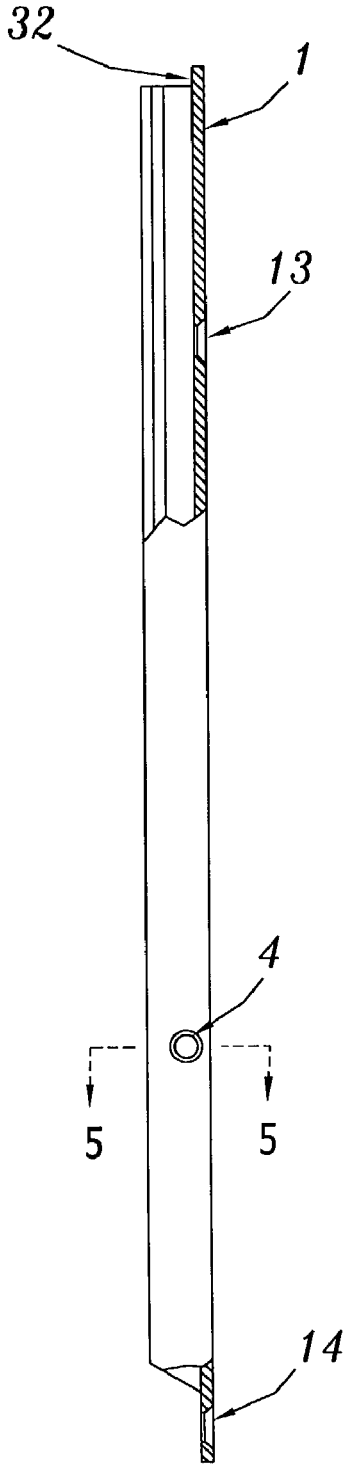
Figure 5:
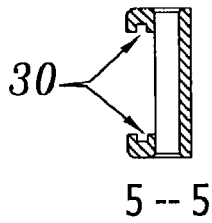
Figure 6:
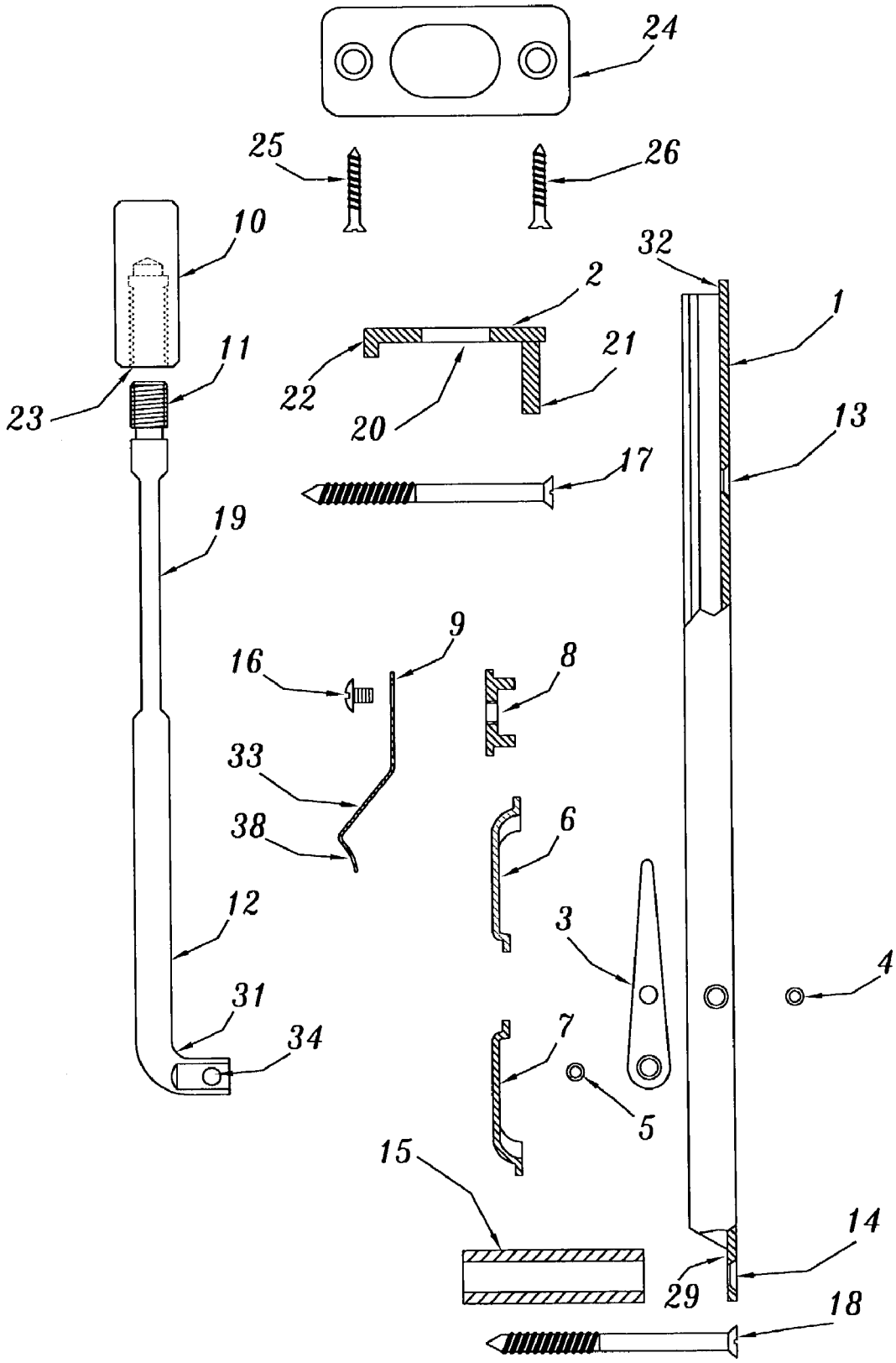

The purpose of the strike plate 24 is to receive and engage with the projected bolt for securing the inactive door. Referring to FIG. 6, the strike plate 24 is in general rectangular, and has round corners. It is die-cut from a flat sheet metal. An elliptical opening is at the center of the strike plate, with the long elliptical axis (X-axis) stretching across the length of the strike plate. At the outer edges of the strike plates, there are two identical-sized screw-holes, where two Phillips flat-headed screws 25, 26 are fastening the strike plate onto the door frame 35 (as shown in FIG. 2). The purpose of having an elliptical opening, instead of a circular opening, at the center of the strike plate is to minimize any possible misalignment between the strike plate and the projected bolt.

I claim:

1. A flush bolt mechanism for latching the inactive door of a pair of doors by projecting a bolt from the horizontal edge of said door into a strike plate located either in the door frame at the top or in the sill at the floor; the said mechanism mounted generally flush with the vertical edge of the said door, comprising:

(a) a housing, (b) a front base which guides a cylindrical bolt as it is projected out or retracted back into the housing, (c) a trigger which is mounted pivotally onto the said housing by a pin, and can manually be moved perpendicularly to the said housing for activating a shaft which then moves vertically to project the cylindrical bolt into a strike plate, (d) two base plates, fastened underneath the trigger to the housing, for supporting the trigger when the bolt mechanism is in either a projected or a retracted position, (e) the shaft is attached at its upper end to the bolt, and at its lower end is connected pivotally with the trigger by a pin, (f) a spring clip for biasing the shaft towards the inactive door, but with sufficient pulling force exerted on the trigger can overcome the biasing force, allowing the shaft to move vertically projecting the bolt, (g) the strike plate is to be engaged with the bolt for latching an inactive door, (h) a cylindrical spacer, and (i) the housing features two channels located on the interior walls of the housing for positioning the two base plates, and for fastening the seat which in turn fastens the spring clip.

2. A flush bolt mechanism of claim 1 wherein the base plates have identical shape and dimensions and are placed at opposite directions underneath the trigger, and are secured to the housing by four stamped V-shaped notches, and are used to support the trigger when the bolt mechanism is either retracted or projected.

* * * * *